United States Patent [19]

Hayashi

[11] Patent Number: 4,597,367

[45] Date of Patent: Jul. 1, 1986

[54] ENGINE VALVE AND METHOD OF PRODUCING THE SAME

[75] Inventor: Yoshimasa Hayashi, Kamakura, Japan

[73] Assignee: Nissan Motor Co., Ltd., Yokohama, Japan

[21] Appl. No.: 481,906

[22] Filed: Apr. 4, 1983

[30] Foreign Application Priority Data

Apr. 5, 1982 [JP] Japan ..... 57-49012[U]

[51] Int. Cl.[4] ..... F01L 3/02

[52] U.S. Cl. ..... 123/188 AA; 251/368

[58] Field of Search ..... 123/188 A, 188 AA; 251/368; 29/156.7 B, 156.7 C

[56] References Cited

U.S. PATENT DOCUMENTS

| | | | |
|---|---|---|---|
| 1,294,416 | 2/1919 | Dady | 123/188 AA |
| 1,714,690 | 5/1929 | Nevins | 123/188 AA |
| 2,089,749 | 8/1937 | Jardine | 123/188 AA |
| 2,119,042 | 5/1938 | Charlton | 123/188 AA |
| 2,183,254 | 12/1939 | Charlton | 123/188 AA |
| 2,316,488 | 4/1943 | Roth | 123/188 AA |
| 2,354,947 | 8/1944 | Colwell | 123/188 AA |
| 2,371,548 | 3/1945 | Saffady | 123/188 AA |
| 2,745,777 | 5/1956 | Clarke | 123/188 AA |
| 3,040,417 | 6/1962 | Newton | 29/156.7 |

FOREIGN PATENT DOCUMENTS

| | | |
|---|---|---|
| DPA2702 | 7/1952 | Fed. Rep. of Germany . |
| 1960331 | 6/1971 | Fed. Rep. of Germany . |
| 620639 | 4/1927 | France . |
| 788537 | 10/1935 | France . |

*Primary Examiner*—Ira S. Lazarus

*Attorney, Agent, or Firm*—Schwartz, Jeffery, Schwaab, Mack, Blumenthal & Evans

[57] ABSTRACT

An engine valve of an internal combustion engine comprises a hollow metal tube member whose one end part is flared into an umbrella-shape, the hollow metal tube member constituting a valve stem section. A generally disc-shaped metal lid member is welded to the umbrella-shaped end part of the hollow metal tube member, constituting a valve head section. Additionally, a metal stem end member is welded to the other end of the hollow metal member, thus decreasing the weight of the valve, thereby reducing total engine noise while improving fuel economy.

14 Claims, 3 Drawing Figures

ENGINE VALVE AND METHOD OF PRODUCING THE SAME

BACKGROUND OF THE INVENTION

1. Field of the Invention

This invention relates in general to an improvement in an engine valve such as an intake or exhaust valve of an internal combustion engine, and more particularly to the engine valve which is hollow for the purpose of weight reduction.

2. Description of the Prior Art

It is well known in the art, that engine valves such as intake and exhaust valves of internal combustion engines are in general formed solid and made of a heat-resistant material. Additionally, it has been proposed in the fields of air plane engines and racing car engines, that exhaust valves subjected to severe thermal condition are formed hollow and filled with sodium. However, either of the above engine valves has disadvantages in that the valve is relatively heavy and accordingly the inertial mass thereof during valve opening and closing operations becomes higher. This unavoidably results in increased engine noise and deteriorated fuel economy.

SUMMARY OF THE INVENTION

According to the first aspect of the present invention, an engine valve of an internal combustion engine comprises a hollow tube member made of metal and formed with a first end part which is flared into a generally umbrella-shape. An open end peripheral portion is formed at the extreme end of the first end part, and the hollow tube member constitutes a valve stem section. A generally disc-shaped lid member made of metal is integrally connected at its peripheral portion with the open end peripheral portion of the hollow tube member. The disc-shaped lid member and the umbrella-shaped first end part of the hollow tube member constitute a valve head section. Additionally, a stem end member made of metal is integrally connected with a second end part of the hollow tube member.

According to a second aspect of the present invention, a method of producing the engine valve comprises the step of spreading the inner diameter of the first end part of the hollow metal tube member to flare the first end part into an umbrella-shape so that the umbrella-shaped first end part has an open end peripheral portion at its extreme end, the hollow metal tube member constituting the valve stem section. The generally disc-shaped metal lid member is welded to the first end part of the hollow metal tube member so that the peripheral portion of the disc-shaped lid member is integrally connected with the open end peripheral portion of the hollow metal tube member, the disc-shaped metal lid member and the umbrella-shaped first end part of the hollow metal tube member constituting a valve head section. Additionally, the metal stem end member is welded to the second end part of the hollow metal tube member.

Accordingly, the engine valve such as an intake or exhaust valve is greatly reduced in weight as compared with conventional valves. This makes it possible to decrease the valve operating force and consequently to simplify the configuration of a total valve operating mechanism, thereby reducing total engine noise while improving fuel economy.

BRIEF DESCRIPTION OF THE DRAWINGS

The features and advantages of the engine valve and the method of producing the same according to the present invention will be more clearly appreciated from the following description taken in conjunction with the accompanying drawing in which the same reference numerals designate the same elements and parts, in which.

DETAILED DESCRIPTION OF THE INVENTION

Figure 1:
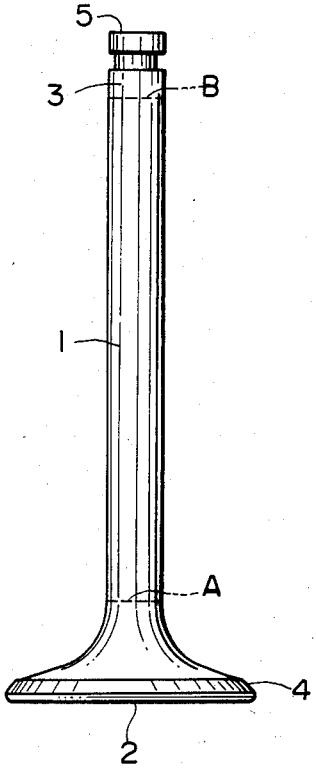
FIG.1 (PRIOR ART)
FIG. 1 is a front elevation of a conventional engine valve of an internal combustion engine.

To facilitate understanding the present invention, brief reference will be made to a conventional engine valve such as an intake or exhaust valve depicted in FIG. 1. The conventional valve includes a valve stem section 1 of a solid rod made of heat-resistant alloy. A valve head section 2 is made of heat-resistant alloy and formed by precision forging, and joined with the valve stem section 1 at a connecting part indicated by a dotted line A by flashing batt welding. A stem end section 3 is similarly made of heat-resistant alloy and formed by precision forging, and joined with the valve stem section 1 at a connecting part indicated by a dotted line B by flash batt welding. Additionally, in order to improve the wear-resistance, stellite composed of Co (40–50%), Cr (25–30%), W (12–17%), and a trace of Fe, C and Mn is deposited on a valve face portion 4 which is brought into contact with a valve seat of a cylinder head and on the extreme end face 5 of the stem end section 3 against which a rocker arm or the like strikes. Otherwise, the whole stem end section 3 may be formed of stellite.

In addition, it has been proposed to use a special exhaust valve in the field of high power output engines (much higher in thermal load) for air planes and racing cars which special exhaust valve is formed hollow in the valve head section and the valve stem section and filled with sodium. With this exhaust valve, the sodium becomes a liquid at operating temperatures and moves in the hollow valve head and stem sections to smoothly transmit the heat of the valve head section to the valve stem section, thereby suppressing excessive temperature rise in the valve head section.

However, both of the above-mentioned valves has drawbacks in that they are heavy and therefore the inertial mass thereof during opening and closing operations is much higher. Such a valve having a higher inertial mass requires a greater valve operating or driving force. In order to obtain a greater valve operating force, it is further required to strengthen rocker arms and valve springs. This unavoidably increases noise caused by valve operation, while degrading fuel economy of engines.

Figure 3:
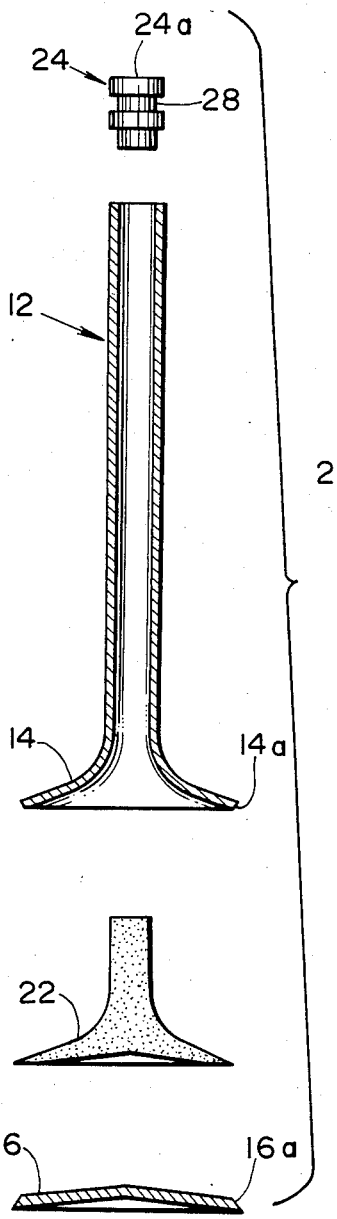
FIG. 3 is an exploded view partly in section of the valve of FIG. 2.
Figure 2:
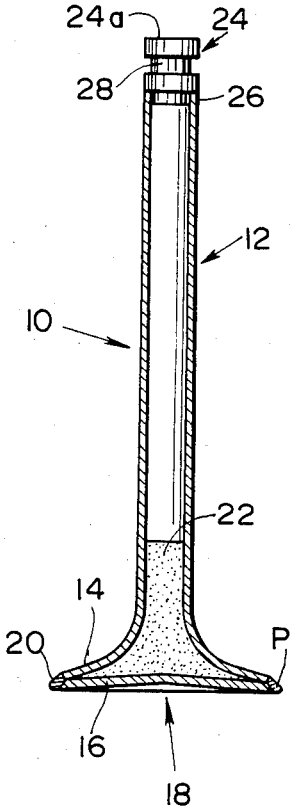
FIG. 2 is a vertical sectional view of a preferred embodiment of an engine valve of an internal combustion engine, in accordance with the present invention.

In view of the above description of the conventional engine valves, reference is now made to FIGS. 2 and 3 wherein a preferred embodiment of an engine valve such as an intake or exhaust valve in accordance with the present invention is illustrated by the reference numeral 10. The valve 10 is, in this case, of an automotive internal combustion engine and comprises a valve stem section 12 which is constructed of a hollow metal tube such as a drawn steel tube. One end or lower end part 14 of the valve stem section 12 is flared into an umbrella-shape so that the inner diameter of the end part 14 gradually increases in the direction toward the extreme end of the end part 14. A generally disc-shaped metal lid member 16, which has been previously press-formed, is welded to the lower end portion 14 of the valve stem section 12. The outer peripheral portion 16*a* of the lid member 16 is secured to or integral with the open end peripheral portion 14*a* of the lower end portion 14 of the valve stem section 12, thereby forming a valve head section 18. In this welding process, a metal material (such as stellite), which is higher in heat-resistance and wear-resistance, is used as a filler metal to form a padding P of the filler metal. The thus formed padding P of the filler metal is thereafter ground to form a valve face 20 which will be brought into contact with a valve seat (not shown) formed at a cylinder head of the engine.

As shown, the interior of the valve head section 18 and a lower part of the valve stem section 12 are filled with light metal filling 22 made of aluminium alloy or the like. In this instance, the light metal filling 22 has been previously formed in the shape shown in FIG. 3 and thereafter located in the interior of the valve head section 18 and the lower part of the valve stem section 12. Otherwise, the light metal filling 22 in a molten state may be poured into the interior of the valve head section 18 and the lower part of the valve stem section 12. Additionally, a stem end section or member 24 is fitted in the other or upper end part 26 (opposite to the end part 14) of the valve stem section 12 and fixed thereto by welding. The stem end section 24 is formed with a groove 28 which will fit with a collet (not shown) or valve stem lock. The stem end section 24 is produced, for example, by precision forging, and at least the upper end face 24*a* thereof is formed of wear-resistant metal such as stellite in order to ensure wear-resistance. It will be understood that the whole stem end section 24 may be formed of the wear-resistant metal. After finishing of the thus produced valve 10, the outer surface of the valve 10 is plated with chromium to form a hard chrome plating layer.

With the thus produced valve 10, almost all of the interior of the valve stem section 12 is formed hollow, and the filling 22 in the valve head section 18 is lower in specific gravity. This renders the valve 10 lighter in weight as a whole. Furthermore, since the ground welding section is used as the valve face 20, a particular step for forming the valve face is not necessary and therefore the production process for the valve 10 can be simplified, thereby greatly contributing to cost reduction in combination with the fact that a forging process becomes unnecessary.

It is to be noted that heat supplied to the valve head section 18 can be smoothly transmitted to the valve stem section 12 through the light alloy filling 22, thereby avoiding deterioration in heat dissapation due to the hollow configuration of the valve 10. Particularly in the case where the valve 10 is used as an exhaust valve which is subjected to high thermal load, the light metal filling 22 becomes molten at a relatively low temperature (for example, about 580° C. in the case of aluminium alloy containing about 12.5% of silicon) and moves hard within the hollow of the valve 10 in the axial direction thereof with open and close movements of the valve 10, so that a large amount of heat can be effectively transmitted to be released, thereby preventing the thermal damage of the valve 10 with certainty. In case where the valve 10 is used as an intake valve, the light metal filling 22 contributes to an improvement in durability of the valve head section 18.

As will be appreciated from the foregoing description, according to the present invention, the intake or exhaust valve of the internal combustion engine can be greatly reduced in weight as compared with a conventional valve which is produced by precision forging, thus reducing the inertial mass of the valve. This makes it possible to decrease valve operating force, thereby achieving simplification and weight reduction of the whole configuration of a valve operating mechanism including rocker arms and valve springs. Accordingly, the inertial mass of the valve operating mechanism is further decreased, so that the deformation of the cylinder head due to valve opening and closing force is reduced, thereby greatly reducing total engine noise while improving fuel economy.

What is claimed is:

1. An engine valve of an internal combustion engine, comprising:

a hollow tube member formed of a drawn steel tube, said hollow tube member having a central portion comprising a tubular body, and a first end part which is flared outwardly and includes an open end peripheral portion at the extreme end of said first end part, said hollow tube member tubular body constituting a valve stem section;

a generally disc-shaped lid member made of metal and having a peripheral portion integrally connected with the open end peripheral portion of said hollow tube member, said lid member and the first end part of said hollow tube member constituting a valve head section; and a stem end member made of metal and integrally connected with a second end part of said hollow tube member;

a filler metal comprising stellite disposed in contact with the open end peripheral portion of said hollow tube member first end part and the peripheral portion of said disc-shaped lid member to secure together said hollow tube member and said lid member to thereby form said integral connection, said stellite filler metal being a wear and corrosion resistant nonferrous alloy, said filler metal being formed as a padding having a peripheral surface including a valve face for contacting a valve seat of an engine; and a filling comprising an aluminum alloy containing silicon, said filling being disposed in said valve head section to fill said valve head section.

2. An engine valve as claimed in claim 1, wherein the inner diameter of the flared first end part of said hollow tube member gradually increases in a direction toward the extreme end of the first end part.

3. An engine valve as claimed in claim 1, wherein the flared first end part of said hollow tube member is formed by spreading the inner diameter of the first end part into an umbrella-shape in which the inner diameter of said hollow tube member first end part gradually increases in a direction toward the extreme end of the first end part.

4. An engine valve as claimed in claim 3, wherein said disc-shaped lid member is integrally connected with said hollow tube member by welding the peripheral portion of said disc-shaped lid member to the open end peripheral portion of said hollow tube member by said filler metal which is high in wear-resistance.

5. An engine valve as claimed in claim 4, wherein said valve face for contacting a valve seat of the engine is formed at a welding section where said disc-shaped lid member is welded to said hollow tube member first end section, said valve face being formed by grinding said welding section.

6. An engine valve as claimed in claim 1, wherein said valve face is formed by grinding the padding of said filler metal.

7. An engine valve as claimed in claim 1, wherein said disc-shaped lid member is formed by press-forming.

8. An engine valve as claimed in claim 1, wherein said stem end member is formed by precision forging.

9. An engine valve as claimed in claim 1, at least a part of said stem end member is formed of a metal which is high in wear-resistance.

10. An engine valve as claimed in claim 9, wherein said metal is stellite.

11. An engine valve as claimed in claim 1, wherein said filling is formed into a predetermined shape before disposed in position.

12. An engine valve as claimed in claim 1, wherein said filling is disposed in position by being poured in the molten state.

13. An engine valve as claimed in claim 1, wherein the content of silicon relative to aluminum alloy is about 12.5%.

14. An engine as claimed in claim 1 wherein said filling has a melting point in the range of 580° C.

* * * * *